US009373469B2

(12) United States Patent
Jang

(10) Patent No.: US 9,373,469 B2
(45) Date of Patent: Jun. 21, 2016

(54) MOLDED CASE CIRCUIT BREAKER

(71) Applicant: LSIS CO., LTD., Anyang-si, Gyeonggi-do (KR)

(72) Inventor: Bong Yun Jang, Cheongju-si (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/476,563

(22) Filed: Sep. 3, 2014

(65) Prior Publication Data

US 2015/0129553 A1 May 14, 2015

(30) Foreign Application Priority Data

Nov. 11, 2013 (KR) ..... 10-2013-0136461

(51) Int. Cl.
*H01H 33/53* (2006.01)
*H01H 9/04* (2006.01)
(Continued)

(52) U.S. Cl.
CPC ..... *H01H 33/53* (2013.01); *H01H 9/047* (2013.01); *H01H 9/342* (2013.01); *H01H 33/022* (2013.01); *H01H 33/64* (2013.01); *H01H 71/0264* (2013.01); *H01H 73/18* (2013.01)

(58) Field of Classification Search
CPC ..... H01H 9/342; H01H 9/02; H01H 9/346; H01H 33/64; H01H 33/022; H01H 33/72; H01H 33/62; H01H 71/02; H01H 73/18
USPC ..... 218/157, 156, 155, 152, 134, 149, 15, 218/34; 335/201, 202
See application file for complete search history.

(56) References Cited

U.S. PATENT DOCUMENTS 5,241,289 A * 8/1993 Markowski ..... H01H 9/342 335/201
5,811,749 A 9/1998 Bausch et al.
(Continued)

FOREIGN PATENT DOCUMENTS

CN 1157053 8/1997
DE 9406404 6/1994
(Continued)

OTHER PUBLICATIONS

Korean Intellectual Property Office Application Serial No. 10-2013-0136461, Office Action dated Sep. 26, 2014, 4 pages.
(Continued)

*Primary Examiner* — Renee S Luebke
*Assistant Examiner* — William Bolton
(74) *Attorney, Agent, or Firm* — Lee, Hong, Degerman, Kang & Waimey PC; Jonathan Kang; Justin Lee

(57) ABSTRACT

Disclosed is a molded case circuit breaker. The molded case circuit breaker includes include: a case; an interrupter assembly installed in the case, and provided with an arc gas outlet; an exhaustion guiding portion disposed between the interrupter assembly and the terminal portion; an exhaustion cover mounted to the case, with a structure to cover the exhaustion guiding portion; and exhaustion guides spaced from each other in the exhaustion guiding portion, in a direction perpendicular to an arc gas discharge direction, in a state where the gas divergence portion is disposed therebetween, the exhaustion guides forming the arc gas passage together with the gas divergence portion. Under such configuration, arc gas discharged out of the arc gas outlet can be rapidly discharged to outside through the exhaustion guides, without an eddy current.

13 Claims, 10 Drawing Sheets

(51) Int. Cl.

| | |
|---|---|
| ***H01H 9/34*** | (2006.01) |
| ***H01H 71/02*** | (2006.01) |
| ***H01H 73/18*** | (2006.01) |
| ***H01H 33/02*** | (2006.01) |
| ***H01H 33/64*** | (2006.01) |

(56) References Cited

U.S. PATENT DOCUMENTS

| | | | | |
|---|---|---|---|---|
| 6,407,354 | B1 * | 6/2002 | Turner | H01H 9/342 218/155 |
| 6,512,192 | B1 * | 1/2003 | Yee | H01H 9/342 218/157 |
| 7,034,241 | B2 | 4/2006 | Fleege et al. | |
| 7,586,057 | B2 * | 9/2009 | Sisson | H01H 9/342 218/157 |
| 2005/0219021 | A1 | 10/2005 | Fleege et al. | |
| 2009/0002106 | A1 | 1/2009 | Harmon et al. | |

FOREIGN PATENT DOCUMENTS

| | | |
|---|---|---|
| EP | 1098330 | 5/2001 |
| JP | 59-170360 | 11/1984 |
| JP | 59-177153 | 11/1984 |
| JP | 60-188456 | 12/1985 |
| JP | 07-021898 | 1/1995 |
| JP | 2002-352692 | 12/2002 |
| JP | 2008-226632 | 9/2008 |
| JP | 2013-037895 | 2/2013 |
| KR | 20-2012-0008674 | 12/2012 |
| KR | 10-1297515 | 8/2013 |

OTHER PUBLICATIONS

European Patent Office Application Serial No. 14188388.4, Search Report dated Mar. 27, 2015, 7 pages.

Korean Intellectual Property Office Application Serial No. 10-2013-0136461, Notice of Allowance dated Mar. 23, 2015, 2 pages.

Japan Patent Office Application Serial No. 2014-185197, Office Action dated Jul. 21, 2015, 3 pages.

Japan Patent Office Application Serial No. 2014-185197, Notice of Allowance dated Jan. 12, 2016, 3 pages.

The State Intellectual Property Office of the People's Republic of China Application No. 2014106378803, Office Action dated Apr. 5, 2016, 7 pages.

* cited by examiner

MOLDED CASE CIRCUIT BREAKER

CROSS-REFERENCE TO RELATED APPLICATION

Pursuant to 35 U.S.C. §119(a), this application claims the benefit of earlier filing date and right of priority to Korean Application No. 10-2013-0136461, filed on Nov. 11, 2013, the contents of which are all hereby incorporated by reference herein in its entirety.

BACKGROUND OF THE DISCLOSURE

1. Field of the Disclosure

The present disclosure relates to a molded case circuit breaker, and particularly, to a molded case circuit breaker capable of preventing a dielectric breakdown due to leakage of arc gas occurring during a short-circuit.

2. Background of the Disclosure

Generally, a molded case circuit breaker (MCCB) is an apparatus provided with a switching mechanism, a trip unit, etc. integrally assembled to each other in a case formed of an insulating material. An electrical path, which is being used, may be open or closed manually or by an electric adjuster provided outside the case. When an overload, a short-circuit, etc. occur, the molded case circuit breaker serves to automatically disconnect the electric path.

If a short-circuit has occurred on a molded case circuit breaker for 3 phases, a trip unit installed in the molded case circuit breaker disconnects an electric path by separating contacts from each other. In this case, arc is generated when the contacts are separated from each other, and the arc gas in a plasma state is discharged to outside through an arc gas vent means provided in the molded case circuit breaker.

FIG. 1 is a perspective view for explaining a vent means for a molded case circuit breaker according to the cited reference D1 of the conventional art.

Referring to FIG. 1, arc gas generated from inside of an interrupter assembly 70 is discharged to a chamber region 100 through an arc gas outlet 80 provided at a lower end of the interrupter assembly 70. The arc gas is diverged to two sides in the chamber region 100, through a gas divergence portion 110 of a triangular shape. Then the arc gas is discharged to outside through a chute 90.

However, the arc gas discharge structure of D1 (U.S. Pat. No. 7,034,241) has the following problems. When the interrupter assembly 70 is coupled to a case, the arc gas outlet is spaced from two side walls of the chamber region 100. Thus, arc gas is introduced into a gap between the arc gas outlet and a wall surface of the case, resulting in an eddy current. This may cause arc gas not to be rapidly discharged out, resulting in a dielectric breakdown.

SUMMARY OF THE DISCLOSURE

Therefore, an aspect of the detailed description is to provide a molded case circuit breaker, capable of rapidly discharging arc gas discharged from an arc gas outlet of the existing interrupter assembly to outside, without an eddy current phenomenon on a wall surface of exhaustion guides.

To achieve these and other advantages and in accordance with the purpose of this specification, as embodied and broadly described herein, there is provided a molded case circuit breaker, including: a case; an interrupter assembly; an exhaustion guiding portion; an exhaustion cover; and exhaustion guides.

The case may be provided with a power side terminal portion and a load side terminal portion to which a power side external terminal and a load side external terminal are connected, respectively.

The interrupter assembly may be installed in the case, and may be provided with an arc gas outlet for discharging arc gas generated from inside of the interrupter assembly to outside.

The exhaustion guiding portion may be disposed between the interrupter assembly and the terminal portion. The exhaustion guiding portion may be provided with a gas divergence portion therein, to thus provide an arc gas passage between the arc gas outlet and a vent chute of the terminal portion.

The exhaustion cover may be mounted to the case, with a structure to cover the exhaustion guiding portion.

The exhaustion guides may be spaced from each other in the exhaustion guiding portion, in a direction perpendicular to an arc gas discharge direction, in a state where the gas divergence portion is disposed therebetween. The exhaustion guides may form the arc gas passage together with the gas divergence portion.

The exhaustion guides may be formed to be tapered such that a width thereof is increased toward the terminal portion, in a direction perpendicular to an arc gas discharge direction.

Two inner side surfaces of the arc gas outlet may be formed to be tapered such that a width of the arc gas outlet is increased toward the terminal portion, in a direction perpendicular to an arc gas discharge direction.

The interrupter assembly may be installed such that the arc gas outlet contacts an entrance of the exhaustion guides without a gap therebetween.

An entrance side end portion of the exhaustion guides may have the same width as an exit side end portion of the arc gas outlet.

The exhaustion guiding portion may be formed for each of three-phase. The arc gas passage diverged by the gas divergence portion and the exhaustion guides may be formed at an inner space of the exhaustion guiding portion.

The gas divergence portion disposed between the exhaustion guides may have a triangular shape, and a vertex of the gas divergence portion may be spaced from the arc gas outlet.

The exhaustion cover may be provided with, on an inner side surface thereof, partition walls spaced from each other in a direction perpendicular to an arc gas discharge direction, such that the exhaustion guiding portion is divided from each other for three-phase. The exhaustion guides may be spaced from each other in a state where the partition wall is interposed therebetween, to thus obtain an insulating distance between phases.

The exhaustion cover may be provided with guide inserting portions spaced from each other in a state where the partition wall is interposed therebetween, and the exhaustion guides may be provided with guide inserting recesses therein. The guide inserting recesses may accommodate the guide inserting portions therein.

The exhaustion cover and the exhaustion guiding portion may be provided with a first coupling portion and a second coupling portion, respectively such that the exhaustion cover is detachably coupled to the case.

In the molded case circuit breaker according to the present invention, arc gas discharged from the arc gas outlet can be rapidly discharged to outside through the exhaustion guides, without an eddy current.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION OF THE DISCLOSURE

Description will now be given in detail of preferred configurations of mobile terminals according to the present invention, with reference to the accompanying drawings.

The present invention relates to a molded case circuit breaker, and more particularly, to an exhaustion guide structure capable of rapidly discharging arc gas occurring when a short-circuit between phases occurs, without an eddy current.

Figure 1:
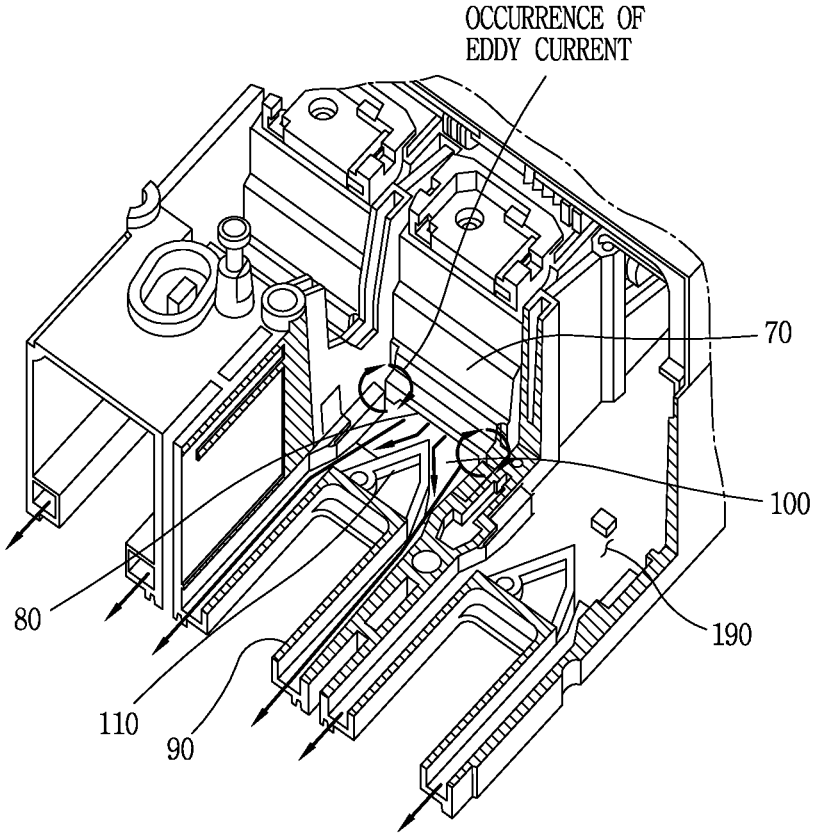
FIG. 1 PRIOR ART
FIG. 1 is a perspective view for explaining a vent means for a molded case circuit breaker according to the cited reference D1 of the conventional art.
Figure 2:
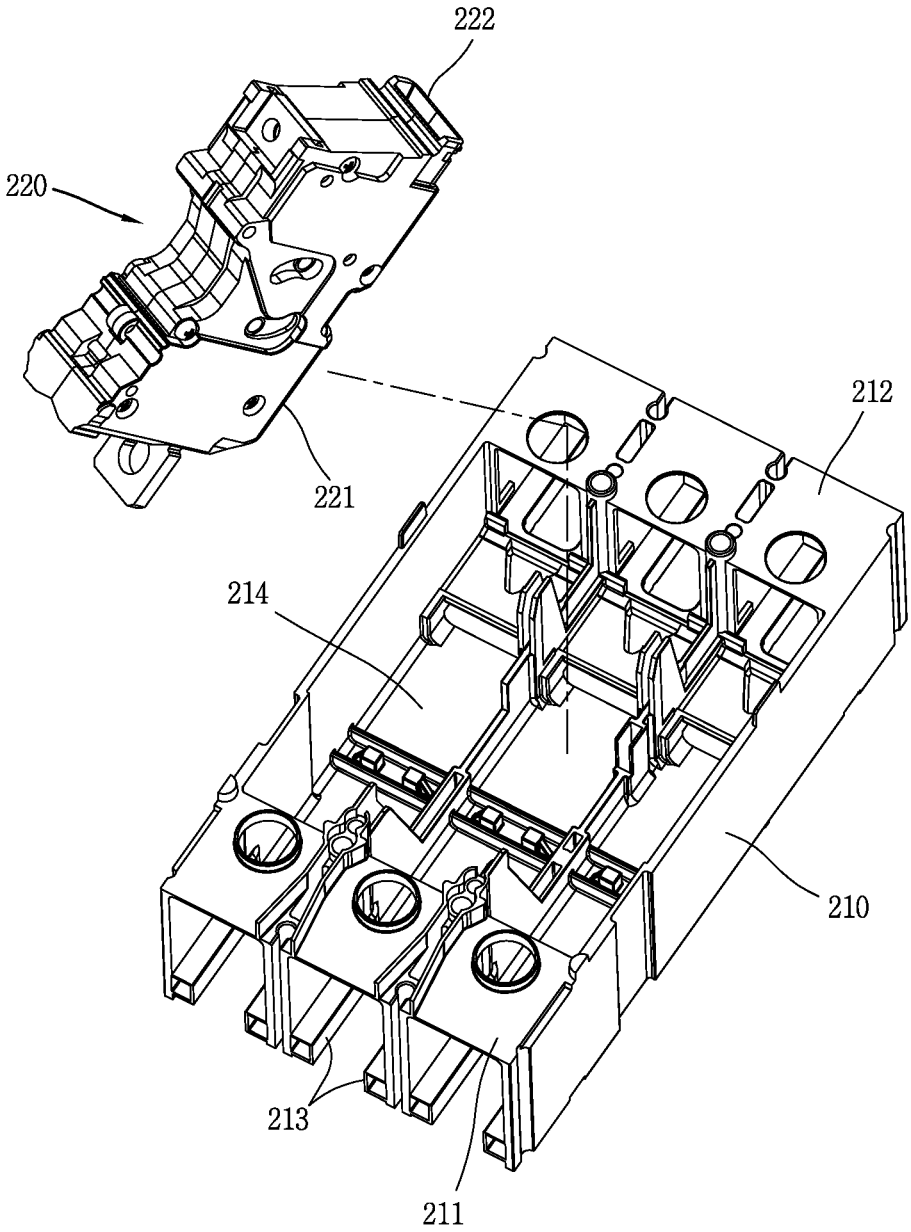
FIG. 2 is an exploded perspective view of a case and an interrupter assembly according to the present invention.
Figure 3:
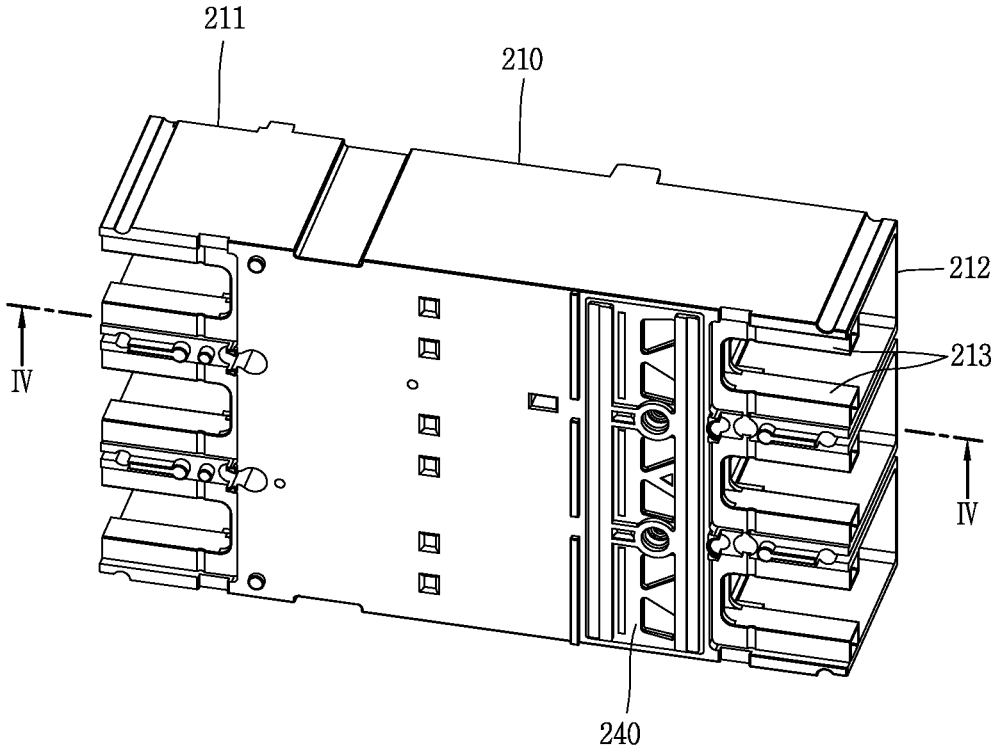
FIG. 3 is a bottom perspective view of a case according to the present invention.
Figure 4:
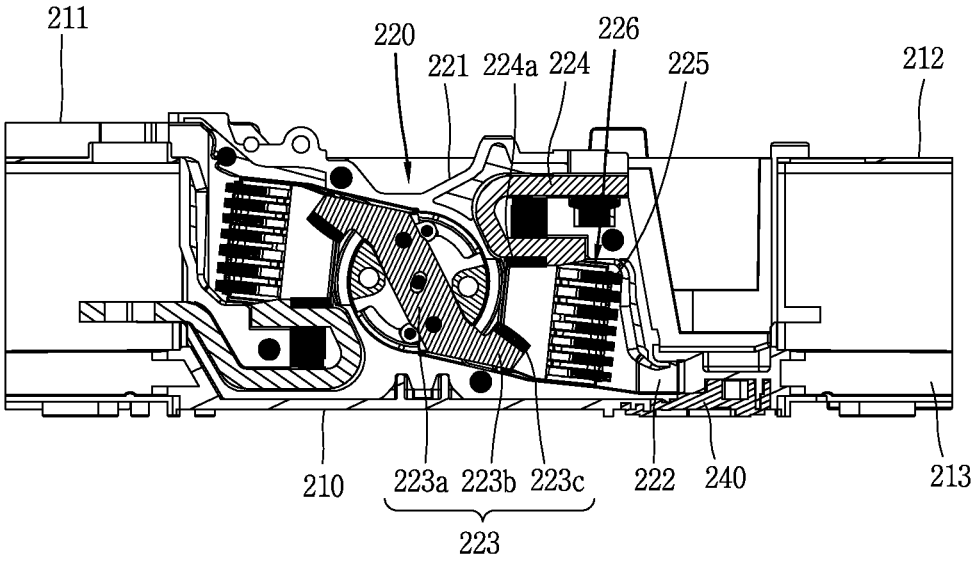
FIG. 4 is a sectional view taken along line 'IV-IV' in FIG. 3.

FIG. 2 is an exploded perspective view of a case and an interrupter assembly according to the present invention, FIG. 3 is a bottom perspective view of a case according to the present invention, and FIG. 4 is a sectional view taken along line 'IV-IV' in FIG. 3.

A molded case circuit breaker according to the present invention includes a case 210, an interrupter assembly 220, and an arc gas exhaustion system.

A molded case circuit breaker according to an embodiment of the present invention may be configured to have three phases of R, S and T.

The case 210 may be divided into an upper case and a lower case for forming appearance of the molded case circuit breaker. The upper case is provided with a handle for turning on/off the molded case circuit breaker, and is positioned at an upper side to thus serve as a cover. The lower case 210 accommodates therein components such as the interrupter assembly 220 and a trip unit. The lower case 210 is positioned at a lower side to thus serve as a body.

The lower case 210 has a rectangular shape. Under an assumption that a longer side is a lengthwise direction and a shorter side is a widthwise direction, a power side terminal portion 211 and a load side terminal portion 212 are provided at two ends of the lower case 210 in the lengthwise direction. The power side terminal portion 211 and the load side terminal portion 212 may be connected to a power and a load, respectively. Each of the power side terminal portion 211 and the load side terminal portion 212 has four closed sides, and is open in the lengthwise direction.

An inner space 214 for accommodating the interrupter assembly 220 is provided between the power side terminal portion 211 and the load side terminal portion 212. The inner spaces 214 for three-phase are divided from each other by partition walls formed in a lengthwise direction with intervals therebetween in a widthwise direction. Power sides of three-phase are connected to or disconnected from load sides of three-phase, independently. An upper surface of the inner space 214 is open.

The interrupter assembly 220 is provided for each of three phases. The interrupter assembly 220 is inserted into the inner space 214 additionally provided at the lower case 210, thereby contacting or separating a fixed contact and a movable contact for each phase to or from each other.

The interrupter assembly 220 includes a housing 221 divided to be symmetrical to each other right and left, based on a lengthwise center line; moving plates 223 and fixed plates 224 provided in the housing 221; and extinguishing units 226 for extinguishing arc gas.

The fixed plates 224 are fixed in the housing 221 in a diagonal direction, and fixed contacts 224*a* are fixed to one ends of the fixed plates 224. The fixed contact 224*a* is positioned within the range of a rotation radius of a movable contact 223*c* of the moving plate 223.

The moving plate 223 may be composed of a moving plate body 223*a* having a center part rotatably-coupled to a shaft positioned at the center of the housing 221; moving plate arm portions 223*b* extending from the moving plate bodies 223*a* in opposite directions; and movable contacts 223*c* provided at ends of the moving plate arm portions 223*b*. The movable contact 223*c* is contactable to or separable from the fixed contact 224*a*, by being interworked with rotation of the moving plate 223.

The extinguishing unit 226 is provided with a plurality of grids 225 spaced from each other in a rotation direction of the moving plate 223 which moves far from the fixed plate 224. The extinguishing units 226 are positioned in the housing 221 near the fixed contacts 224*a* of the fixed plates 224, in a diagonal direction, thereby extinguishing arc generated between the movable contacts 223*c* and the fixed contacts 224*a*. The grids 225 are configured to guide an arc to be introduced into a gap therebetween. The grids 225 may cut an arc and extinguish the arc by moving the arc to ends thereof.

Figure 5:
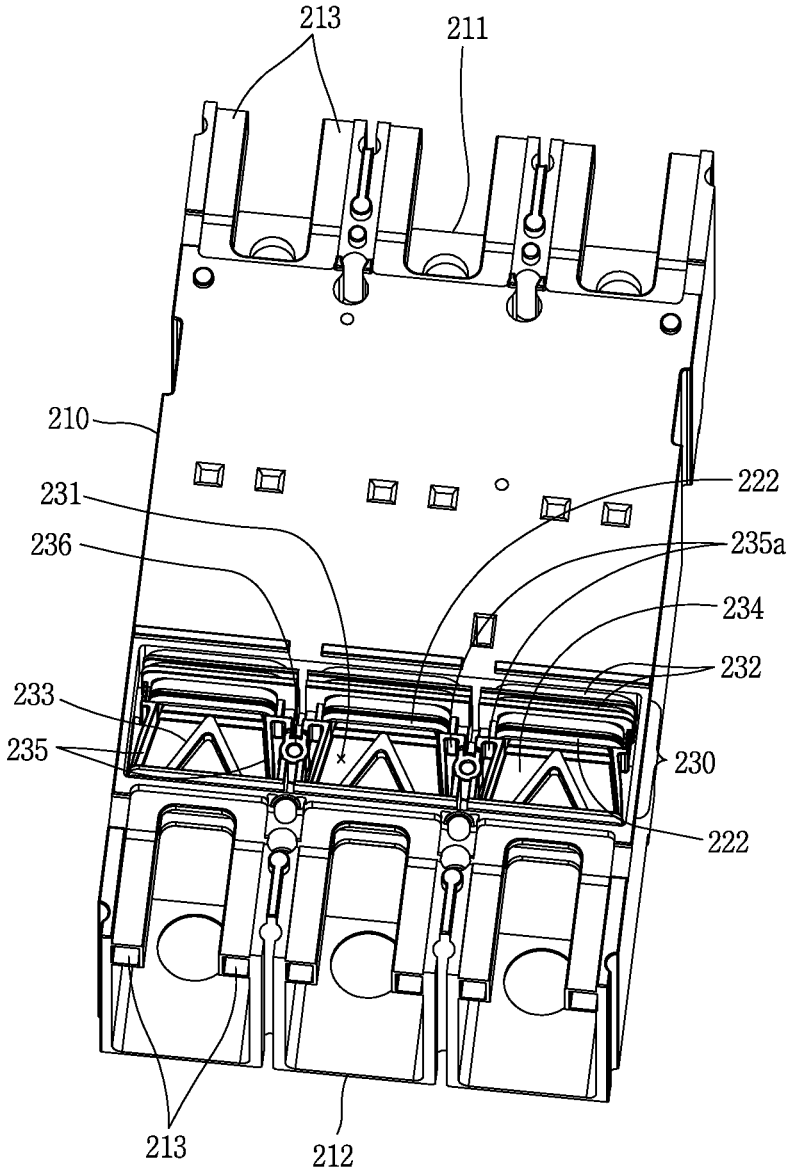
FIG. 5 is a bottom perspective view illustrating a state that an exhaustion cover of FIG. 3 has been detached from case.
Figure 6:
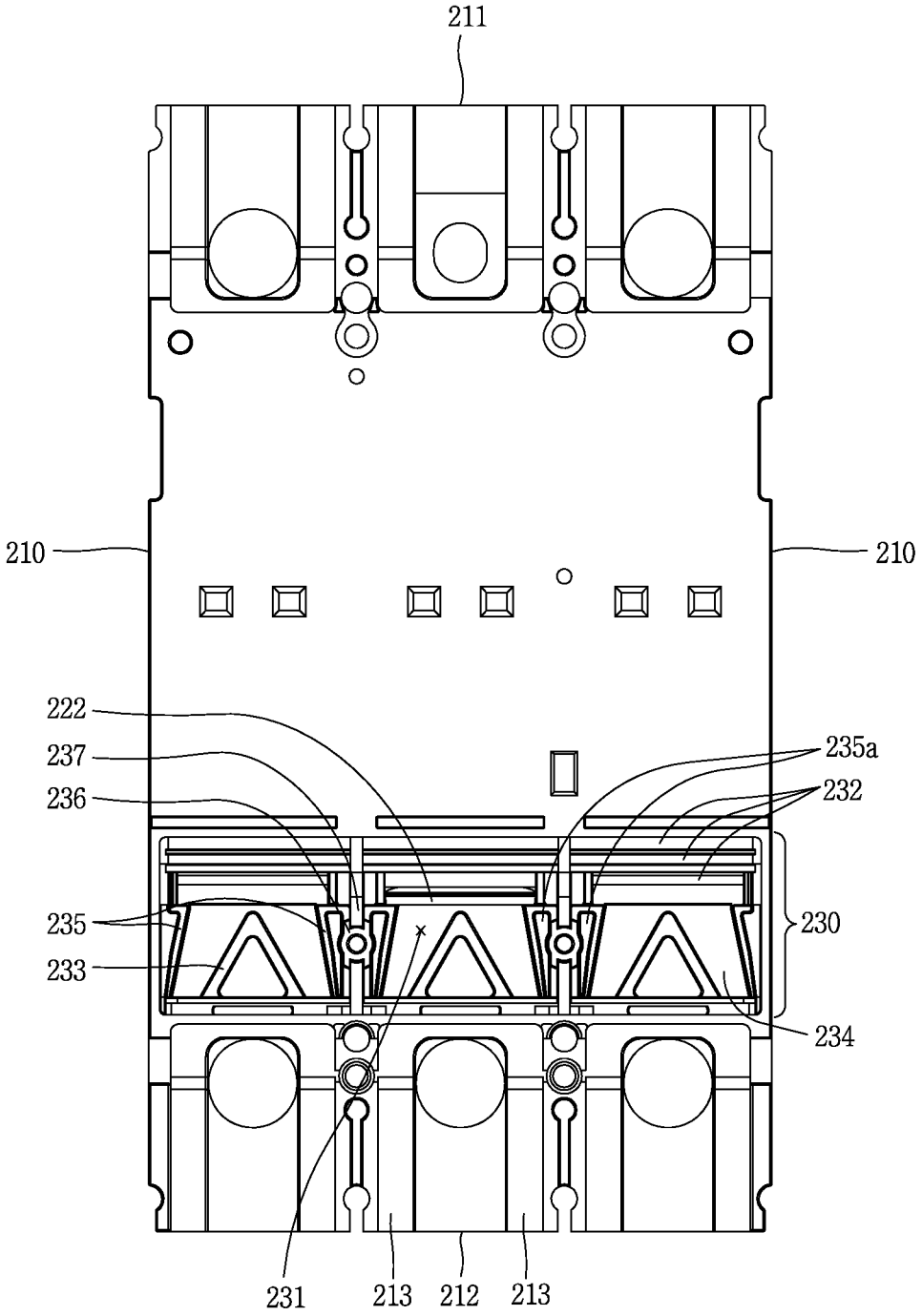
FIG. 6 is a bottom view of FIG. 5.
Figure 7:
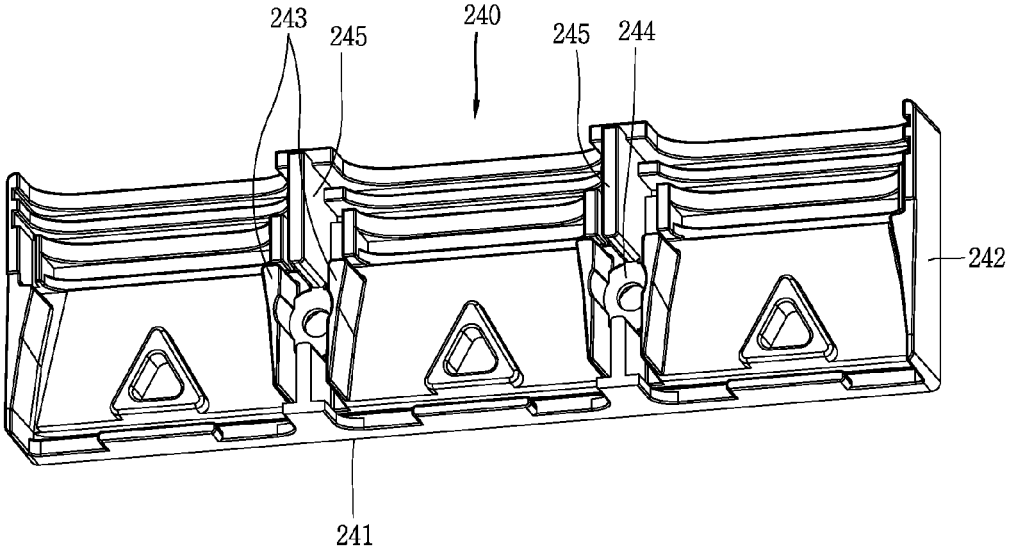
FIG. 7 is a perspective view illustrating an inner side surface of an exhaustion cover according to the present invention.
Figure 8:
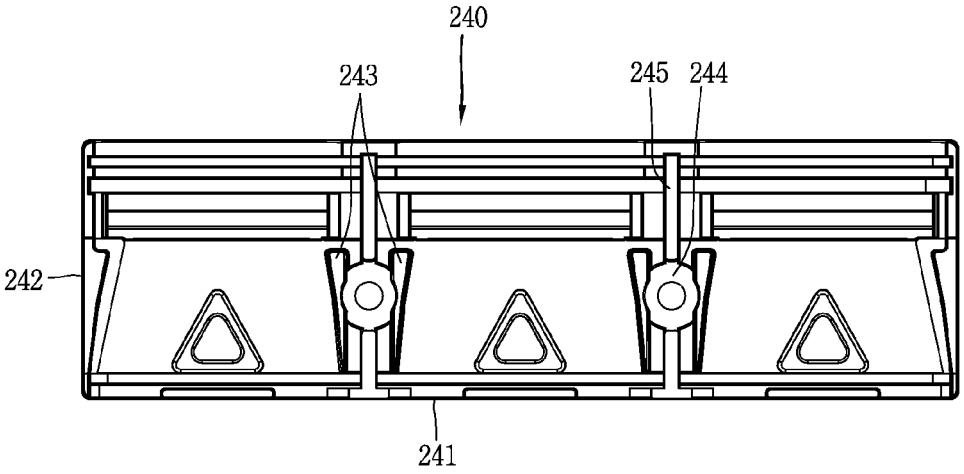
FIG. 8 is a planar view illustrating the inner side surface of the exhaustion cover of FIG. 7.

FIG. 5 is a bottom perspective view illustrating a state that an exhaustion cover of FIG. 3 has been detached from a case, FIG. 6 is a bottom view of FIG. 5, FIG. 7 is a perspective view illustrating an inner side surface of an exhaustion cover according to the present invention, and FIG. 8 is a planar view illustrating the inner side surface of the exhaustion cover of FIG. 7.

The arc gas exhaustion system may include an arc gas outlet 222 provided at a housing 221; a vent chute 213 provided at the load side terminal portion 212; and an exhaustion guiding portion 230 disposed between the arc gas outlet 222 and the vent chute 213.

The arc gas outlets 222 may be formed at two ends of the housing 221 so as to be adjacent to the extinguishing unit 226, so that arc gas generated between contacts in the interrupter assembly 220 can be discharged to outside through the arc gas outlet 222.

The power side terminal portion 211 and the load side terminal portion 212 are connected to an external power side terminal and an external load side terminal, respectively. A vent chute 213 is formed in a state where the load side terminal portion 212 is interposed therebetween, thereby discharging arc gas to outside.

The trip unit is installed in the case 210 so as to be adjacent to the load side terminal portion 212, and is disposed above the exhaustion guiding portion 230 to be explained later. The trip unit serves to automatically separate contacts from each other when a short-circuit has occurred.

The exhaustion guiding portion 230 is provided between the inner space 214 of the case 210 and the load side terminal portion 212. And the exhaustion guiding portion 230 is provided with a discharge chamber 231 disposed between the arc gas outlet 222 and the vent chute 213, and the discharge chamber 231 providing an arc gas passage.

The exhaustion guiding portion 230 is provided with a shielding member 234 spaced from a bottom surface of the lower case 210 which contacts an installation surface of the molded case circuit breaker, in a height direction. The shielding member 234 is configured to separate the inner space 214 of the case 210 and the discharge chamber 231 from each other. The shielding member 234 can prevent arc gas discharged to the discharge chamber from being introduced into the case 210, and can help the arc gas be rapidly discharged to outside through the vent chute 213.

The shielding member 234 has a plate structure. One end of the shielding member 234 comes in contact with the load side terminal portion 212, and another end thereof is horizontally-extending from the load side terminal portion 212 toward the arc gas outlet 222 to thus be contactable to the arc gas outlet 222.

An insertion portion 232 having a "ㄷ"-shaped sectional surface is formed at one side of the exhaustion guiding portion 230 (upstream side of an arc gas discharge direction (Y)), in a structure to enclose an outer side surface of the arc gas outlet 222. For instance, the arc gas outlet 222 has a closed quadrangular sectional surface. The insertion portion 232 is formed to enclose "ㄷ"-shaped three surfaces adjacent to each other, among outer side surfaces of the arc gas outlet 222. And the insertion portion 232 is formed to be communicated with the discharge chamber 231. Under such configuration, when the interrupter assembly 220 is inserted into the case 210, the arc gas outlet 222 is inserted into the insertion portion 232. As a result, arc gas generated from inside of the interrupter assembly 220 can be discharged to the discharge chamber 231.

The exhaustion guiding portion 230 is provided with a triangular gas divergence portion 233 configured to diverge arc gas discharged from the arc gas outlet 222 to two sides, and configured to guide flow of the arc gas to a pair of vent chutes 213 spaced from each other for each phase.

The gas divergence portion 233 is formed at the end of the shielding member 234 in the form of a triangle, so that the vertex of the triangle can be positioned on a center line of a width of the arc gas outlet 222. And the gas divergence portion 233 is spaced from the end of the arc gas outlet 222 by a predetermined interval (G) in a discharge direction of arc gas. Under such configuration, a flow resistance of arc gas can be minimized, and arc gas can be rapidly discharged to outside. A distance between the arc gas outlet 222 and the vertex of the gas divergence portion 233 is not limited. However, the arc gas outlet 222 and the vertex of the gas divergence portion 233 are preferably formed to have a distance therebetween, for a minimized gas flow resistance. According to experiments, a flow resistance is smaller than in a case where the distance between the arc gas outlet 222 and the vertex of the gas divergence portion 233 is zero.

The gas divergence portions 233 for three-phase are spaced from each other.

The exhaustion guiding portion 230 has an opening at a surface facing an installation surface of the molded case circuit breaker. In order to cover the opening, an exhaustion cover 240 is installed at the exhaustion guiding portion 230.

The exhaustion cover 240 may be detachably mounted to a lower surface of the case 210, and may open and close an opening of the exhaustion guiding portion 230.

The reason why the exhaustion cover 240 separately fabricated from the case 210 is detachably mounted to the case 210, is in order to obtain an insulating property. This will be explained in more detail.

As aforementioned, in order to integrally form the triangular gas divergence portion 233 provided at the exhaustion guiding portion 230, with the case 210 by injection molding, etc., an upper surface or a lower surface of the gas divergence portion 233 should be open due to a molding system design.

In a case where the upper surface of the gas divergence portion 233 is open like in the cited reference, arc gas generated from the interrupter assembly may be discharged to inside of the case 210 through the upper surface of the gas divergence portion 233. This may cause an electrical breakdown between conductors in the case 210, resulting in a short-circuit.

In order to solve such problem, in the present invention, the upper surface of the gas divergence portion 233 is blocked by the shielding member 234, while the lower surface of the gas divergence portion 233 is open. However, the exhaustion cover 240 is mounted so that an opening of the exhaustion guiding portion 230, a lower surface of the gas divergence portion 233, can be open or closed. Accordingly, an insulated state between the case 210 and the earth can be obtained.

That is, since the exhaustion guiding portion 230 is shielded from an inner space of the case 210 by the shielding members 234, arc gas can be prevented from being introduced into the case 210. Further, since the exhaustion cover 240 is installed to shield the exhaustion guiding portion 230 from the earth, arc gas can be prevented from leaking to outside of the case 210.

The exhaustion cover 240 includes a cover body 241 having a plate type and formed to be long in a direction (X) perpendicular to an arc gas discharge direction (Y); end plates 242 protruding from two ends of the cover body 241 in a lengthwise direction, so as to be inserted into the case 210; and partition walls 245 spaced from each other between the end plates 242 in a direction perpendicular to the arc gas discharge direction (Y).

The exhaustion guiding portion 230 may be provided with an inner space for three-phase, by the partition walls 245 formed on an inner side surface of the exhaustion cover 240.

The exhaustion guiding portion 230 for each phase is provided with exhaustion guides 235 disposed at two sides of the gas divergence portion 233. The exhaustion guides 235 provide an arc gas passage along which arc gas discharged from the arc gas outlet 222 is diverged to two sides. The arc gas passage serves as a connection passage between the arc gas outlet 222 and the vent chute 213.

However, in a case where the exhaustion guides 235 are spaced from the end of the arc gas outlet 222, arc gas discharged from the arc gas outlet 222 is introduced into a gap between the exhaustion guides 235 and the arc gas outlet 222, before reaching an entrance of the exhaustion guides 235. As a result, an eddy current may occur. This may cause arc gas not to be rapidly discharged to outside.

In order to solve such problems, a gap between the arc gas outlet 222 and the exhaustion guides 235 is removed, thereby preventing an eddy current of arc gas. Further, two inner side surfaces of the arc gas outlet 222 are connected to the exhaustion guides 235 with the same gradient. This can allow arc gas to be rapidly discharged to outside through the exhaustion guides 235, without any interference.

Figure 9:
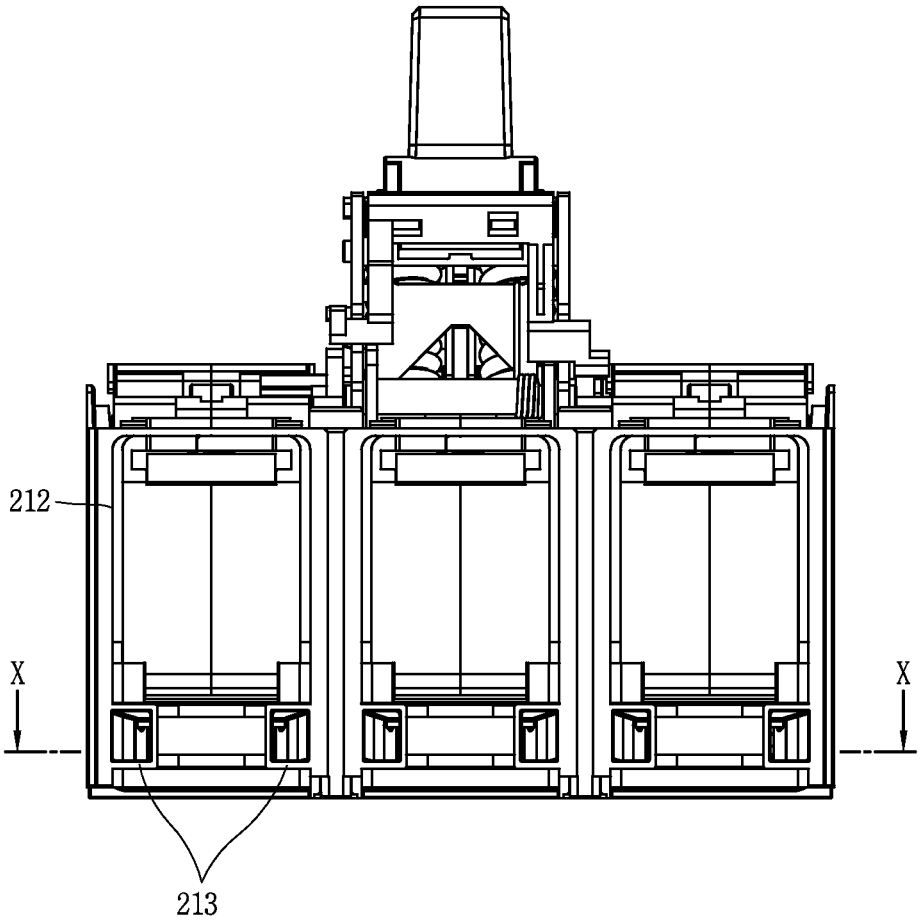
FIG. 9 is a side view of a load side terminal portion of a molded case circuit breaker according to the present invention.
Figure 10:
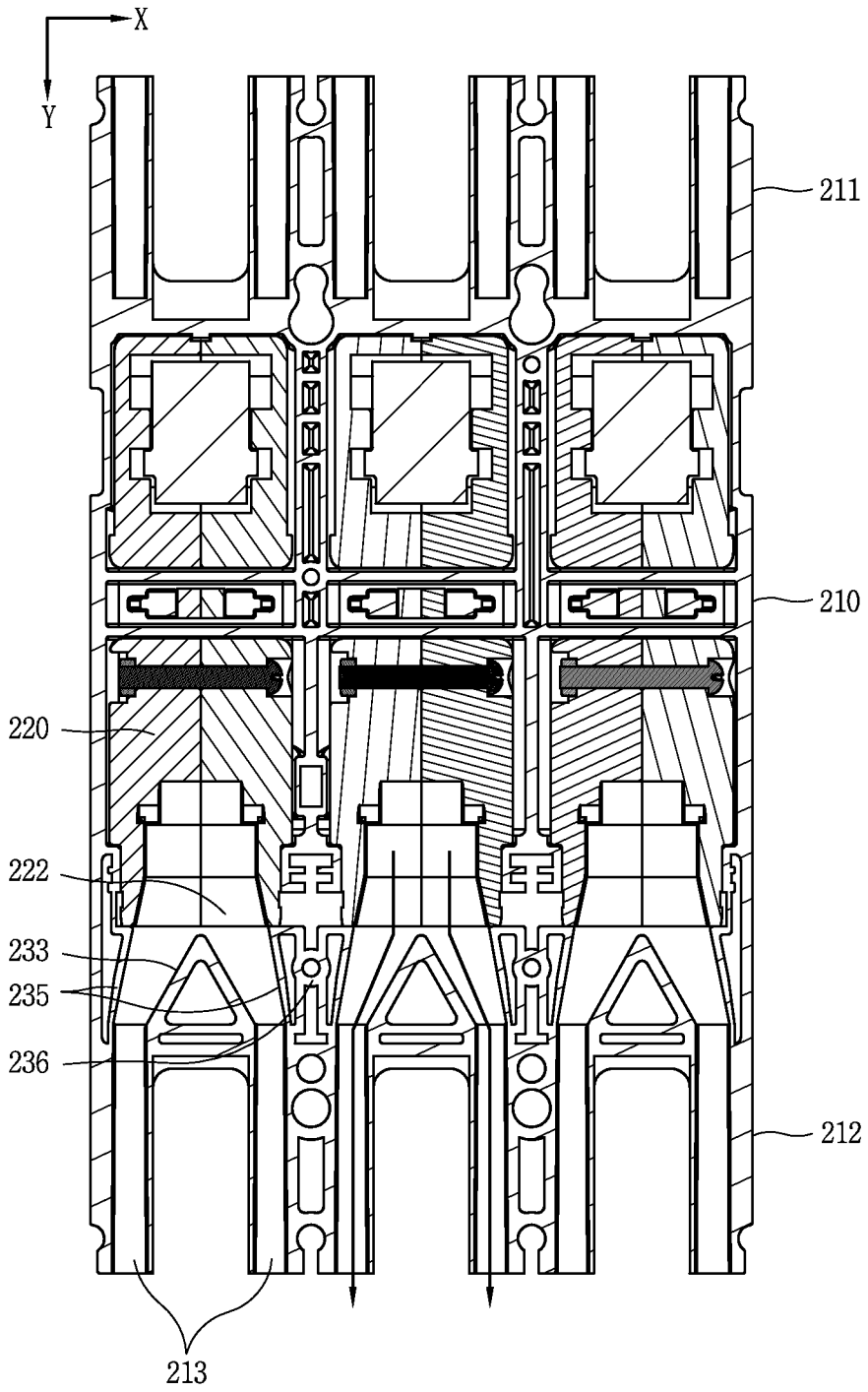
FIG. 10 is a sectional view taken along line 'X-X' in FIG. 9.

FIG. 9 is a side view of a load side terminal portion of a molded case circuit breaker according to the present invention, and FIG. 10 is a sectional view taken along line 'X-X' in FIG. 9.

Two inner side surfaces of the arc gas outlet 222 are formed to be tapered so that a width of the arc gas outlet 222 can be increased toward the terminal portion in the housing 221, in a direction (X) perpendicular to an arc gas discharge direction (Y). Under such configuration, arc gas generated from inside of the housing 221 can be smoothly discharged to the discharge chamber 231.

The exhaustion guides 235 are spaced from the gas divergence portion 233 in a direction (X) perpendicular to an arc gas discharge direction (Y), thereby providing an arc gas passage between the exhaustion guides 235 and the gas divergence portion 233.

The exhaustion guides 235 for three-phase are formed so that a width thereof can be gradually increased toward the terminal portion, in the direction (X) perpendicular to the arc gas discharge direction (Y).

One side surface of the exhaustion guides 235 has the same inclination surface (tapered surface) as an inner side surface of the arc gas outlet 222. That is, the exhaustion guides 235 and the arc gas outlet 222 are inclined to have the same gradient. Thus, arc gas can be consecutively discharged to the vent chute 213 from the inner side surface of the arc gas outlet 222.

The exhaustion guiding portion 230 for three-phase is divided from each other by the partition walls 245 formed on an inner side surface of the exhaustion cover 240. When the exhaustion cover 240 is assembled to an opening of the exhaustion guiding portion 230, a gap may be generated between the partition walls 245 and the shielding member 234 of the exhaustion guiding portion 230. Arc gas may overflow to an adjacent area through the gap.

To prevent such overflow, the exhaustion guides 235, disposed at an intermediate part of the exhaustion guiding portion 230, protrude from the exhaustion guiding portion 230 in a state where the partition wall 245 of the exhaustion cover 240 is interposed therebetween. A partition accommodating recess 237 is formed between the exhaustion guides 235 spaced from each other. Once the partition walls 245 are inserted into the partition accommodating recesses 237, overflow of arc gas to a gap between the shielding member 234 and the partition wall 245 can be prevented.

The exhaustion guides 235 positioned at an intermediate part of the exhaustion guiding portion 230 have approximately a right-angled triangular shape, and guide inserting recesses 235*a* are formed in the exhaustion guides 235. Guide inserting portions 243 protrude from an inner side surface of the exhaustion cover 240, in a spaced manner from the partition wall 245, thereby being inserted into the guide inserting recesses 235*a*.

The guide inserting portions 243 are coupled to the guide inserting recesses 235*a* of the exhaustion guides 235, and the partition walls 245 are coupled to the partition accommodating recesses 237. Due to such double coupling structure, a gap between the divided spaces can be sealed more effectively, and an insulating distance between phases can be obtained.

The exhaustion cover 240 is detachably coupled to the exhaustion guiding portion 230 positioned on a lower surface of the case 210. A first coupling portion 236 protrudes between the exhaustion guides 235 of the exhaustion guiding portion 230, and a second coupling portion 244 protrudes from an inner side surface of the exhaustion cover 240. The exhaustion cover 240 may be coupled to the case 210 using a coupling member such as screws, in a state where the second coupling portion 244 has been disposed above the first coupling portion 236.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A molded case circuit breaker, comprising:

a case provided with a power side terminal portion and a load side terminal portion to which a power side external terminal and a load side external terminal are respectively connected;

an interrupter assembly installed in the case and provided with an arc gas outlet for externally discharging arc gas generated from inside the interrupter assembly;

an exhaustion guiding portion disposed between the interrupter assembly and the load side terminal portion and comprising a gas divergence portion configured to provide an arc gas passage diverged to two vent chutes of the load side terminal portion;

an exhaustion cover mounted to the case configured to cover the exhaustion guiding portion; and exhaustion guides spaced from each other in the exhaustion guiding portion in a direction perpendicular to an arc gas discharge direction, wherein the gas divergence portion is disposed between the exhaustion guides and the arc gas passage is formed by the exhaustion guides and the gas divergence portion, wherein the exhaustion guiding portion comprises an opening facing an installation surface of the molded case circuit breaker and the exhaustion cover is detachably mounted to a lower surface of the case and configured to open and close the opening of the exhaustion guiding portion.

2. The molded case circuit breaker of claim 1, wherein the exhaustion guides are tapered such that a width is increased toward the load side terminal portion in a direction perpendicular to the arc gas discharge direction.

3. The molded case circuit breaker of claim 2, comprising a plurality of exhaustion guiding portions each corresponding to a phase of three phases, and wherein the arc gas passage is diverged by the gas divergence portion and the exhaustion guides and is formed at an inner space of the exhaustion guiding portion.

4. The molded case circuit breaker of claim 3, wherein the exhaustion cover and the exhaustion guiding portion respectively comprise a first coupling portion and a second coupling portion such that the exhaustion cover is detachably coupled to the case.

5. The molded case circuit breaker of claim 2, wherein the gas divergence portion has a triangular shape and a vertex of the gas divergence portion is spaced from the arc gas outlet.

6. The molded case circuit breaker of claim 5, wherein:

the exhaustion cover comprises guide inserting portions spaced from each other and a partition wall is interposed between the guide inserting portions, the exhaustion guides comprise guide inserting recesses, and the guide inserting recesses are configured to accommodate the guide inserting portions.

7. The molded case circuit breaker of claim 1, wherein two inner side surfaces of the arc gas outlet are tapered such that a width of the arc gas outlet is increased toward the load side terminal portion in a direction perpendicular to the arc gas discharge direction.

8. The molded case circuit breaker of claim 7, wherein the gas divergence portion has a triangular shape and a vertex of the gas divergence portion is spaced from the arc gas outlet.

9. The molded case circuit breaker of claim 1, wherein the interrupter assembly is installed such that the arc gas outlet contacts an entrance of the exhaustion guides without a gap therebetween.

10. The molded case circuit breaker of claim 9, wherein the gas divergence portion has a triangular shape and a vertex of the gas divergence portion is spaced from the arc gas outlet.

11. The molded case circuit breaker of claim 1, wherein an entrance side end portion of the exhaustion guides has the same width as an exit side end portion of the arc gas outlet.

12. The molded case circuit breaker of claim 11, wherein:

the exhaustion cover comprises partition walls spaced from each other in a direction perpendicular to the arc gas discharge direction at inner sides of the exhaustion cover such that the exhaustion guiding portion for one phase is separated from an exhaustion guiding portion for another phase; and the exhaustion guides are spaced from each other and the partition wall is interposed between the exhaustion guides defining an insulating distance between exhaustion guiding portions for each phase.

13. The molded case circuit breaker of claim 11, wherein the gas divergence portion has a triangular shape and a vertex of the gas divergence portion is spaced from the arc gas outlet.

* * * * *